United States Patent [19]

Hingos

[11] Patent Number: 5,029,424

[45] Date of Patent: Jul. 9, 1991

[54] DECORATIVE QUOIN

[75] Inventor: Donald D. Hingos, Albertville, Minn.

[73] Assignee: Zimmerman Stucco and Plastic, Inc., Wayzata, Minn.

[21] Appl. No.: 362,308

[22] Filed: Jun. 6, 1989

[51] Int. Cl.[5] ..... E04C 2/08

[52] U.S. Cl. ..... 52/314; 52/309.7; 52/383

[58] Field of Search ..... 52/85, 610, 612, 384, 52/388, 314, 543, 309.7, 309.4, 384; 428/703

[56] References Cited

U.S. PATENT DOCUMENTS

| | | | |
|---|---|---|---|
| 1,592,591 | 7/1926 | Amele | 52/314 |
| 1,649,872 | 11/1927 | Swisher | 52/612 |
| 1,853,824 | 4/1932 | Krauss | 52/314 |
| 3,067,545 | 12/1962 | Gaines | 52/543 |
| 3,332,187 | 7/1967 | Arcari | 52/388 |
| 3,426,490 | 2/1969 | Taylor | 52/204 |
| 3,679,529 | 7/1972 | Prusinski et al. | 52/309.7 |
| 4,394,201 | 7/1983 | Hauessler | 428/703 |

*Primary Examiner*—James L. Ridgill, Jr.
*Attorney, Agent, or Firm*—Hugh D. Jaeger

[57] ABSTRACT

A decorative quoin which is prefabricated and manufactured for application to corners of a building, such as a home or other structure. Cement, or like material in the form of a square, rectangle or other desired geometrical shape is applied about a wire mesh member to form a quoin which is applied to a building corner. In this example, the quoin is fashioned about a right angle mesh and forms a right angle quoin. The mesh is secured to the building, and the decorative quoin is then stuccoed into the structure and about the other stucco structure.

1 Claim, 3 Drawing Sheets

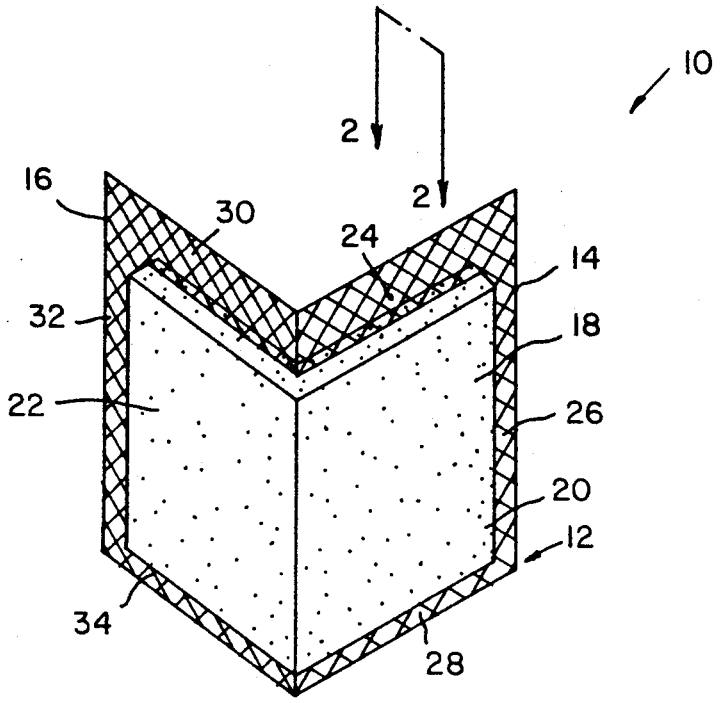
FIG. 1
FIG. 4
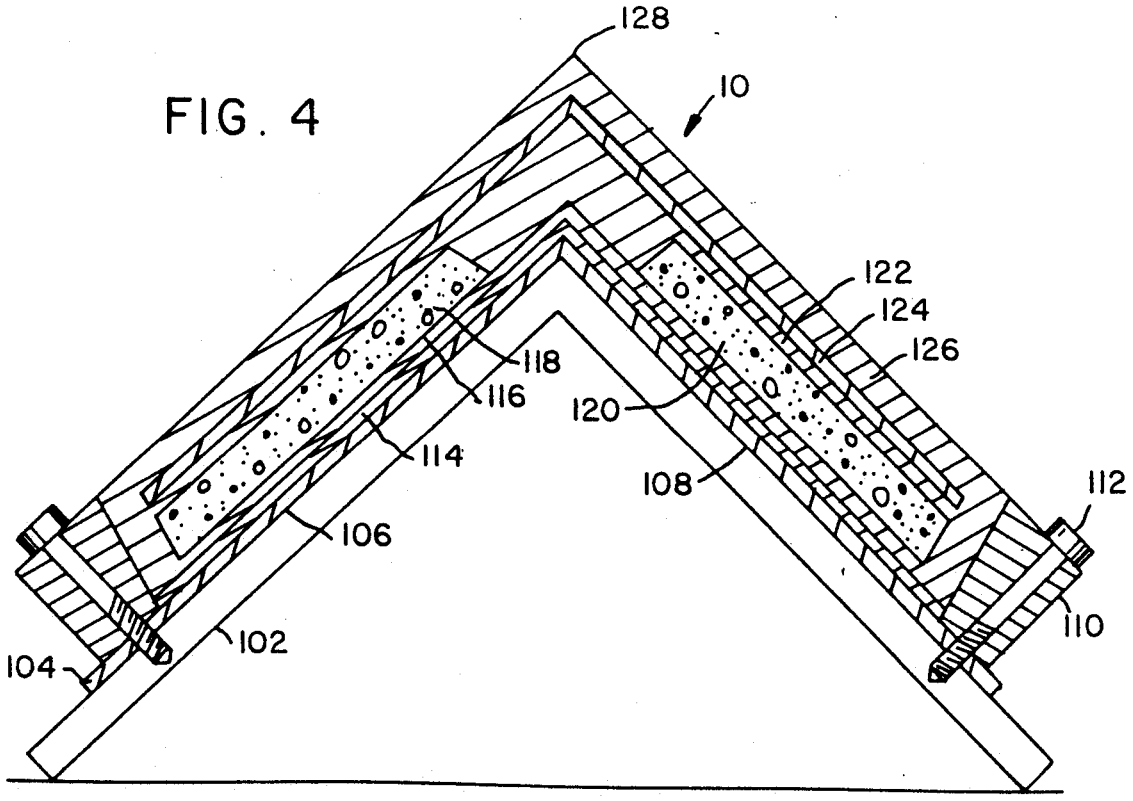

DECORATIVE QUOIN

CROSS REFERENCES TO CO-PENDING APPLICATIONS

None.

BACKGROUND OF THE INVENTION

1. Field of the Invention

The present invention pertains to a decorative quoin, and more particularly, pertains to a performed decorative quoin for attachment to a building structure.

2. Description of the Prior Art

Prior art decorative quoins on buildings were hand formed by wooden members, lathed with mesh and then stuccoed causing an excess of required labor effort and expense, as each quoin had to be individually hand formed. Each quoin had to be carefully formed into place such as by a carpenter and then lathed with wire mesh.

The present invention overcomes the disadvantages of the prior art by providing a performed decorative quoin which is simply secured to a building corner by nails or screws.

SUMMARY OF THE INVENTION

The general purpose of the present invention is a quoin, and more particularly, relates to a prefabricated quoin which is applied to an intersection of walls of a building structure. After securing the prefabricated quoin to the building, stucco is applied over wire mesh mounting tabs extending from the quoin and over and about the quoin.

According to one embodiment of the present invention, there is provided a prefabricated quoin including an angled wire mesh member with a rectangular or other predetermined geometrical shaped cement like material cast over and about the angled wire mesh lath member. The quoin is usually built over a mold such as wood sprayed with oil or over tar paper. Depending on the size of the quoin, an insert such as foam board or the like can be positioned inside the cement like member to reduce weight.

Another preferred embodiment of the present invention is a prefabricated quoin of a tar paper base, mesh, cement like material, an optional foam insert to reduce weight, cement like material, an optional second screen, and cement like material. One type of cement like material is later described in the specification.

One significant aspect and feature of the present invention is a prefabricated quoin which is aesthetically and cosmetically pleasing.

Another significant aspect and feature of the present invention is a prefabricated quoin with outwardly extending mesh tabs which is easy to install by the stuccoer.

Another significant aspect and feature of the present invention is a prefabricated quoin which is light weight and easily handled by a single individual.

Having thus described one embodiment of the present invention, it is the principal object hereof to provide a prefabricated quoin for stucco.

One object of the present invention is a structural quoin which is inexpensive to prefabricate and simple to install in a matter of minutes by a single individual. An entire structure can be "quoined" by a single individual in a very short time, especially compared to the prior art methods of an individual forming each quoin, then individual lathing each quoin, and then stuccoing each quoin which would take from hours to days.

BRIEF DESCRIPTION OF THE DRAWINGS

Other objects of the present invention and many of the attendant advantages of the present invention will be readily appreciated as the same becomes better understood by reference to the following detailed description when considered in connection with the accompanying drawings, in which like reference numerals designate like parts throughout the figures thereof and wherein:

FIG. 1 illustrates a perspective view of a prefabricated quoin;

FIG. 4 illustrates a cross-sectional view of the quoin of FIG. 3 being made over a mold; and, FIG. 5 illustrates the mode of operation of the prefabricated quoin.

DESCRIPTION OF THE PREFERRED EMBODIMENTS

Figure 2:
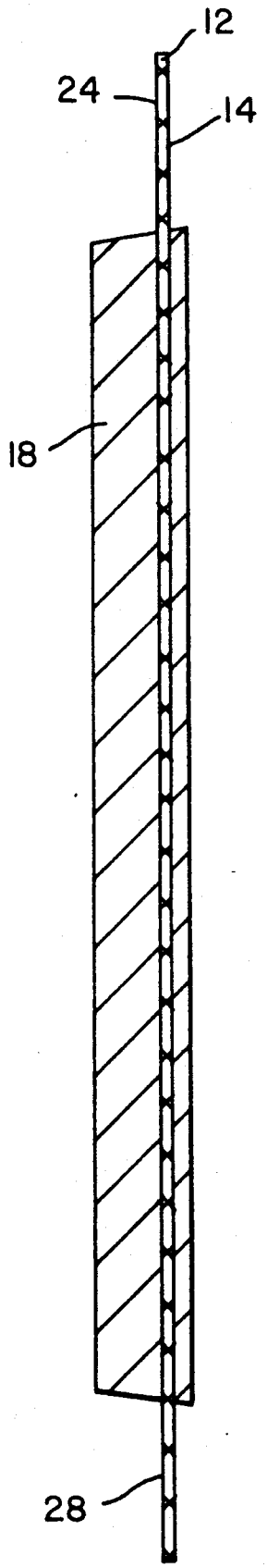
FIG. 2 illustrates a sectional view of the prefabricated quoin along line 2—2 of FIG. 1.

FIG. 1 illustrates a perspective view of the prefabricated structural quoin 10 including an angled wire mesh screen 12 with planar portions 14 and 16. Planar portion 14 and planar portion 16, each part of the angled wire mesh screen 12, are illustrated at right angles to each other, but can be any desired angle to accommodate intersecting walls of other than 90' angles of a structure. Stucco cement, portland cement, or a like cement material, as later described, is troweled and formed over the right angled planar portions 14 and 16 to form the contiguous right angle stucco member 18, and includes intersecting rectangular solid stucco members 20 and 22. Planar portion 14 extends outwardly from the rectangular solid stucco member 20 to form rectangularly shaped mounting tabs 24, 26 and 28. In a similar fashion, planar portion 16 extends from the rectangular solid stucco member 22 to form rectangular mounting tabs 30, 32 and 34. Nails or staples can then be driven through the mounting tabs 24–34 to secure the prefabricated quoin to a building corner. The surrounding edges 36, 38, 40, 42, 44 and 46 can be beveled at an angle as also illustrated in FIG. 2 to provide an aesthetically pleasing quoin.

One preferred formulation for the cement like material is set forth in Table 1 . Of course, it is within the teachings of this patent to use any other suitable cement like materials to form the quoin structures.

1. 2-94 lb sacks of Northwestern Plasterlith type IA waterproof portland cement.
2. ½ sack of Northwestern mason cement.
3. 1 gallon of Dix-Mix.
4. 50 shovels of common coarse sand.
5. 1 bag of Raylite masonry insulation.

FIG. 2 illustrates a cross-sectional view of the prefabricated quoin 10 along line 2—2 of FIG. 1 where all numerals correspond to those elements previously described. It is noted that planar portion 14 is offset from the center of the right angle stucco member 18 and to the rear to allow a maximum reveal of the stucco material from planar portion 14 and a minimum reveal along the rear side of planar portion 14. A tar paper backing 48 can be applied to the back of the quoin during the manufacturing process.

DESCRIPTION OF THE ALTERNATIVE EMBODIMENT

Figure 3:
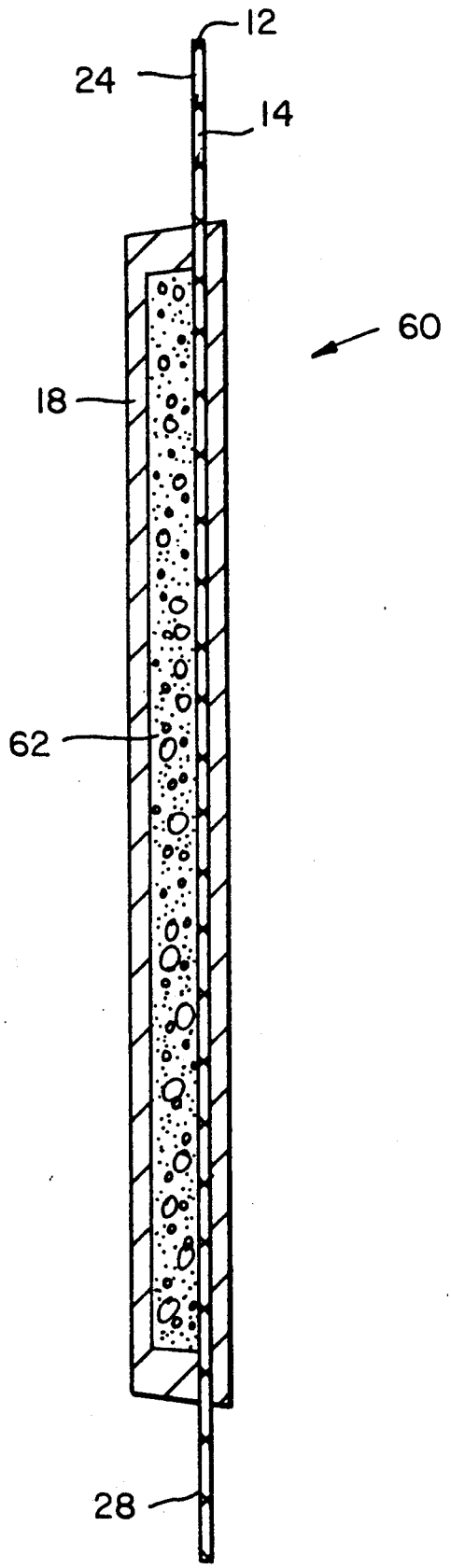
FIG. 3 illustrates an alternative embodiment of the prefabricated quoin.

FIG. 3 illustrates an alternative embodiment in cross section of a light weight, prefabricated structural quoin 60 where all numerals correspond to those elements previously described. A light weight insert such as a foam insulation member 62 is molded into each face of the right angle stucco member 18 to reduce over all unit weight. In the alternative, the foam can be molded over and about planar portion 14, and extend to the back side to further reduce unit weight and also increase the insulative value of the prefabricated structural quoin 60.

MODE OF OPERATION

FIG. 4 illustrates a cross-sectional view of a right angle quoin 100 being made over a wood or like mold 102. Tar paper 104 covers the two faces 106 and 108 of the wood mold. Then, edging 110 is secured to the mold such as by screws 112. The edging in this example forms a square about the four sides of the quoin. Next screen mesh or lath 114 is laid in position over the tar paper. A layer of cement material 116 is applied. Optional foam board 118 and 120 are placed in position. Another layer of cement or like material 122 is applied over the foam board. Another optional screen or metal lath 124 can be applied over the foam board for structural support. A final layer of the cement or like material 126 is applied and the forward edge 128 formed, whether the edge is a right angle as illustrated or a curved edge by example. The above is one example of manufacturing, and is not to be construed as limiting of the present invention as the relationship of the components can vary within the teachings of the present invention.

Figure 5:
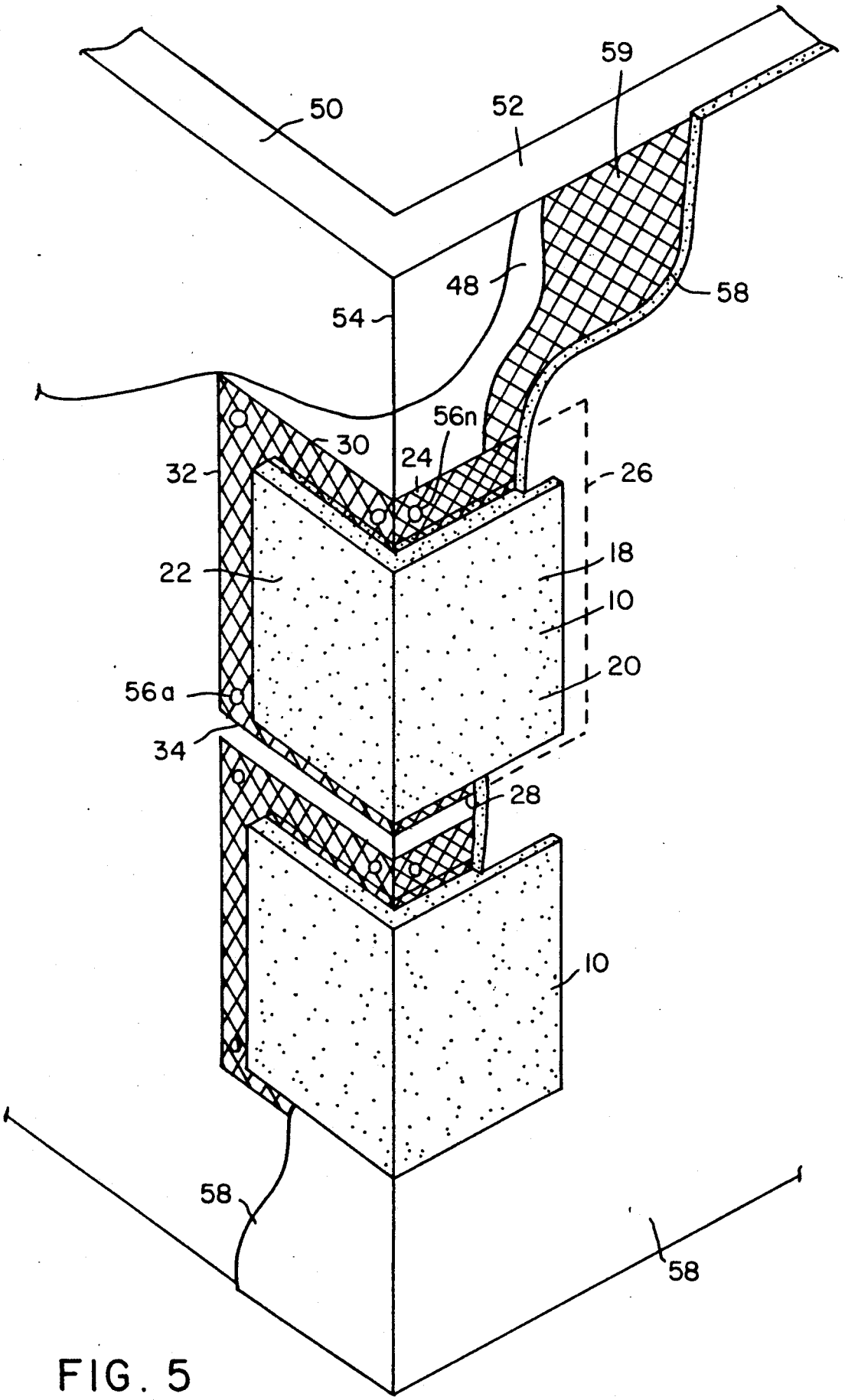

FIG. 5 illustrates the mode of operation of a pair of quoins 10 where all numerals correspond to those elements previously described. Tar paper 48 is applied along intersecting walls 50 and 52 and across vertical edge 54 of the walls 50 and 52. Then the quoins 10 are positioned on the intersection of the walls 50 ans 52, and aligned with the vertical edge 54. A plurality of fasteners **56*a*–56*n*, either staples, screws, nails or other suitable fasteners, fasten over and about the mounting tabs 24-34 to secure the contiguous rectangular solid stucco members 20 and 22 over vertical edge 54 and to the intersecting walls 50 and 52. Decorative stucco 58 is then applied by conventional means to bridge over an applied stucco mesh 59 on the intersecting walls 50 and 52 and the mounting tabs 24–34**.

The quoins are made in wood, or like molds, conforming in physical shape to the desired quoin structure as previously described.

Various modifications can be made to the present invention without departing from the apparent scope hereof. For example, the teachings of the present invention also pertain to quoining which can be secured on the face of a building to provide three dimensions to a structure, and those teachings can be used to fabricate such a quoin.

I claim:

1. A prefabricated structural stucco quoin comprising:

a. an angled section of screen;

b. tar paper on a back side of said screen;

c. concrete means surrounding a portion of said screen;

d. a section of centered foam material over each angle of said concrete and said screen;

e. concrete means about said foam board, said concrete means including materials from the group consisting of waterproof cement, mason cement, sand, and masonary insulation;

f. a smaller right angled section of screen over said foam board and said concrete means; and, g. said concrete means substantially surrounding said screens and said foam material and forming an edge about the angled section of said screens whereby said screens and said foam material are aligned to thereby form a prefabricated structural stucco quoin.

* * * * *